US005495805A

United States Patent [19]

Beisel et al.

[11] Patent Number: 5,495,805

[45] Date of Patent: Mar. 5, 1996

[54] DEVICE FOR SUPPLYING PRINTING PLATES TO A PRINTING MACHINE

[75] Inventors: Hermann Beisel, Walldorf; Peter T. Blaser, Dielheim; Dieter Hauck, Eberbach; Rudolf Hutzenlaub, Mannheim; Helmut Jäger, Königsbach-Stein; Hans-Georg Jahn, Wiesenbach; Robert Müller, Mörlenbach; Anton Rodi, Leimen; Nikolaus Spiegel, Walldorf, all of Germany

[73] Assignee: Heidelberger Druckmaschinen AG, Heidelberg, Germany

[21] Appl. No.: 211,098

[22] PCT Filed: Sep. 7, 1992

[86] PCT No.: PCT/EP92/02057

§ 371 Date: May 12, 1994

§ 102(e) Date: May 12, 1994

[87] PCT Pub. No.: WO93/04864

PCT Pub. Date: Mar. 18, 1993

[30] Foreign Application Priority Data

Sep. 12, 1991 [DE] Germany ..... 41 30 359.8

[51] Int. Cl.[6] ..... B41F 21/00

[52] U.S. Cl. ..... 101/477; 101/415.1

[58] Field of Search ..... 101/477, 415.1, 101/382.1, DIG. 36

[56] References Cited

U.S. PATENT DOCUMENTS 5,259,314 11/1993 Sugiyama ..... 101/477

FOREIGN PATENT DOCUMENTS 0169647 7/1987 Japan ..... 101/415.1
0204038 8/1990 Japan ..... 101/415.1
0068402 1/1994 Japan ..... 101/415.1

*Primary Examiner*—Christopher A. Bennett
*Attorney, Agent, or Firm*—Herbert L. Lerner; Laurence A. Greenberg

[57] ABSTRACT

A device designed as a magazine is disclosed for supplying printing plates to a plate cylinder of a printing machine, in particular to ensure the automatic exchange of printing plates by means of a plate supply arrangement. The plate supply arrangement (16) has several distributed (second) holding means (55) for the printing plates (9) that can be successively activated.

17 Claims, 11 Drawing Sheets

Fig. 7
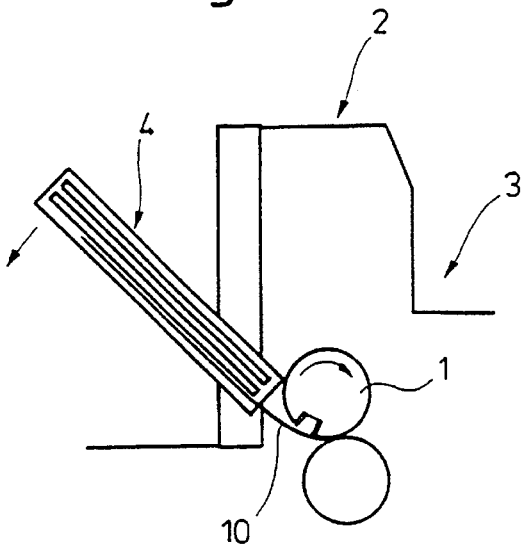
Fig. 8
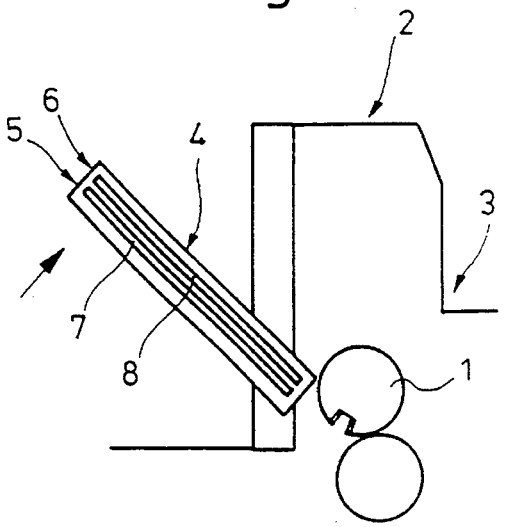
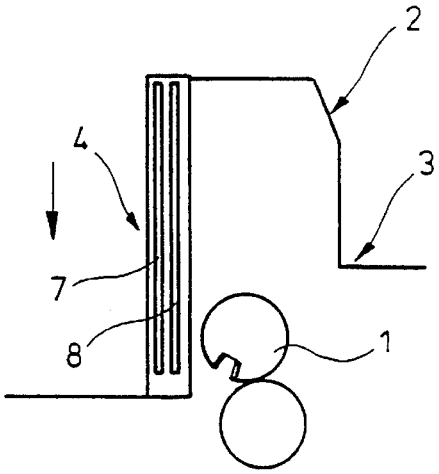
Fig. 9

DEVICE FOR SUPPLYING PRINTING PLATES TO A PRINTING MACHINE

BACKGROUND OF THE INVENTION

FIELD OF THE INVENTION

The invention relates to a device, in the form of a magazine, for supplying printing plates to a plate cylinder of a printing press, in particular for the automatic or semi-automatic changing of printing plates, with a plate-supplying apparatus.

A device of the initially mentioned kind is known from European patent application 0 435 410. The purpose of said device is to automate the changing of printing plates. The magazine holds old, used plates. For removal, the used printing plate is released from the plate cylinder at one end and is then—through appropriate rotation of the plate cylinder—partially inserted into the magazine. Subsequently, the other end of the printing plate is released by the tensioning device of the plate cylinder and the entire printing plate is introduced into the magazine with a plate-removing apparatus. Subsequently, a new printing plate to be used is taken from the magazine by means of the plate-supplying apparatus. First, one end of the printing plate is inserted into the corresponding clamping device of the plate cylinder, where it is clamped, and then—through rotation of the plate cylinder—the printing plate is removed completely from the magazine and is drawn around the outer cylindrical surface of the plate cylinder. Then, the other end of the printing plate is clamped and the plate is tensioned in the circumferential direction. The supplying of printing plates may be disrupted if, when a new printing plate is removed, at least one other of the new printing plates held in a pile in the magazine unintentionally changes its position.

SUMMARY OF THE INVENTION

The object of the invention is to create a device of the initially mentioned kind, the device permitting the operationally reliable supplying of printing plates while being of simple construction and small design.

The object of the invention is achieved in that the plate-supplying apparatus comprises a plurality of distributed, consecutively activatable (second) holding means for the printing plate.

In order to supply a new printing plate to be used, the printing plate is taken from the cassette of the magazine, supplied to the plate cylinder and clamped thereon. This operation takes place fully automatically or, alternatively, semi-automatically using the plate-supplying apparatus, with the non-simultaneous, but preferably consecutive activation of the second holding means over the length of the yet to be used printing plate having the advantage that the printing plate to be used can be lifted perfectly from the pile of new printing plates in the cassette, without—thanks to the flatness of the positioning—any further printing plate being lifted or slid out as a result of the formation of a vacuum. Preferably, the second holding means are in the form of activatable second suction elements.

It is advantageous if the second holding means are disposed on a second carriage, said carriage being movable along a second guide. Further disposed inside the magazine is a sensor which monitors the printing plate to be used, particularly the rear edge thereof, for correct supplying to the plate cylinder.

During the plate-supplying operation, the second holding means associated with the front edge of the new printing plate release the printing plate while it is more or less in the clamping position or hold it so loosely that the printing plate is displaceably held before the printing-plate front edge is clamped on the plate cylinder. The purpose of this is so that the printing plate can be better aligned during clamping. After the front edge has been clamped, tile plate cylinder rotates and pulls the new printing plate completely out of the cassette of the magazine. Both for the alignment of the printing plate and also for its removal from the cassette, the suction elements serving as the holding means may, for example by means of a bypass, be provided with such a weak vacuum that the printing plate slides on the suction elements.

As the angled printing-plate rear edge approaches a row of suckers, said row is taken out of operation and brackets ensure that the edge slides past. By the time the printing plate has been drawn in so far that the last row of suckers must be passed, it exhibits such a stiffness that, in order to prevent a collision, said holding means are adapted, while the printing plate is being supplied to the plate cylinder, to be moved controllably transversely with respect to the plane of the printing plate, with the result that they can be passed correctly, preferably without collision, by the preferably angled rear edge of the printing plate.

Furthermore, it is advantageous if the magazine comprises at least one pressing-on element movable by activation radially with respect to the plate cylinder, particularly a pressing-on roller, for introducing the rear edge into a clamping device of the plate cylinder, with the result that, through the closing of the clamping device, the printing plate can then be fixed and clamped.

Moreover, it is advantageous to employ a pressing-down device, said pressing-down device engaging the yet to be used printing plates remaining in the cassette transversely with respect to the planes thereof, in order to prevent their tipping out from the cassette. Otherwise, such tipping-out might occur particularly when, after an automatic plate change has been performed, the magazine is swiveled back into its vertical position.

It has already been explained hereinbefore that the lifting of a new printing plate from the pile of printing plates inside the cassette is effected not simultaneously over the whole surface area, but is staggered in such a manner that air is able to get between the plates, in order to prevent the printing plates from "sticking together". For example, suction-gripping by the rear, upper row of suckers may be effected first, followed by the middle row and finally by the lower row of suction elements. Moreover, it may preferably be provided that a cassette holding the printing plates to be used—said cassette being insertable into the magazine—comprises spacers, said spacers being disposed between adjacent printing plates. Said spacers prevent a vacuum from forming between the individual printing plates. They may be in the form of plastic tabs. Preferably, they are adapted to be fixed on the cassette in the locking seat. Consequently, when a cassette is being filled, a spacer (or a plurality of spacers) is first clipped into the cassette in such a manner that it is disposed on the surface of an inserted printing plate. Only then is a further new printing plate inserted into the cassette. The spacers are so flexible that they yield when a below-lying printing plate is removed.

The invention is illustrated on the basis of a specimen embodiment with respect to the drawings, in which:

BRIEF DESCRIPTION OF THE DRAWINGS

FIG. 7 shows the magazine in the plate-changing position during acceptance of the used printing plate;

FIG. 8 shows a representation according to FIG. 7, with, however, the printing plate already being completely in a cassette of the magazine;

FIG. 9 shows the magazine once again in the starting position;

DESCRIPTION OF THE PREFERRED EMBODIMENT

Figure 1:
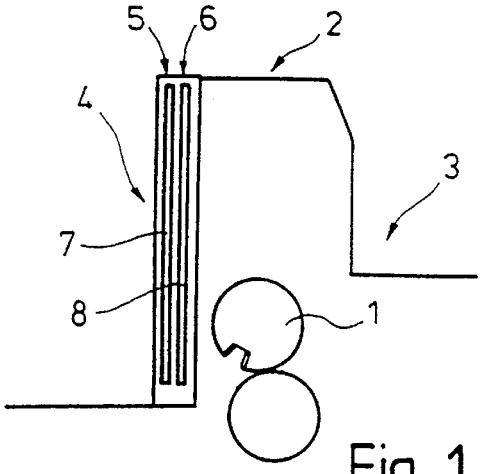
FIG. 1 shows a printing unit of a printing press in a schematic representation with a magazine in the starting position.

In order to provide for automatic or semi-automatic changing of printing plates—that is, to remove an old, used printing plate and then to supply a new printing plate to be used to the plate cylinder 1 of a printing unit 2 of a printing press 3—the printing unit 2 comprises a device in the form of a magazine 4. The magazine 4, which, in the case of a printing press 3 with a plurality of printing units 2, is provided on each printing unit 2 of the printing press 3, may also be used merely to supply a new printing plate to be used or merely to remove an already used printing plate (FIG. 1 to 9).

In FIG. 1, the magazine 4 is in its starting position (vertical position). In this idle position, the magazine 4 is secured (locked) against tilting. Normal printing-press operation (printing mode) is possible only with the magazine 4 in this lower, vertical position.

The magazine 4 comprises two holding shafts 5 and 6, into which cassettes 7 and 8, respectively, are insertable from above (FIG. 1). The cassette 7 is used to hold old printing plates which have already been used in the printing press 3. The cassette 7 is of such design that it is capable of holding a plurality of, for example five, used printing plates. Said printing plates form a printing-plate pile inside the cassette 7; that is, the individual printing plates are in flat contact with one another. The cassette 8 is used to hold new printing plates that are yet to be used. It, too, is capable of holding a plurality of, particularly five, printing plates simultaneously, with, once again, said printing plates being in flat association with one another. In order to remove the used printing plates, it is thus merely necessary to withdraw the cassette 7 out of the holding shaft 5. Once outside of the printing press 3, the cassette 8 can be furnished with new printing plates yet to be used. Once this has been done, the cassette 8 is inserted into the holding shaft 6 of the magazine 4, with the result that it is available for supplying the plate cylinder 1 of the corresponding printing unit 2.

Figure 2:
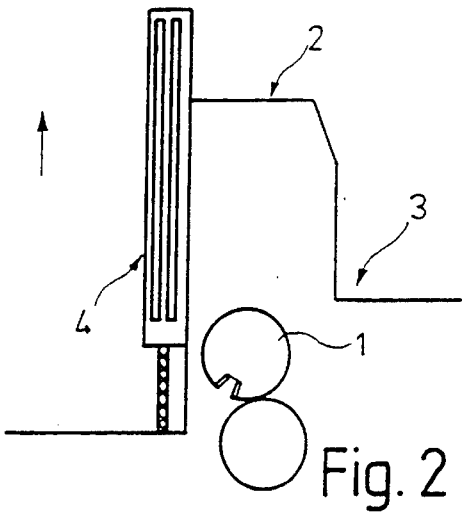
FIG. 2 shows the magazine from FIG. 1 in a center position.
Figure 3:
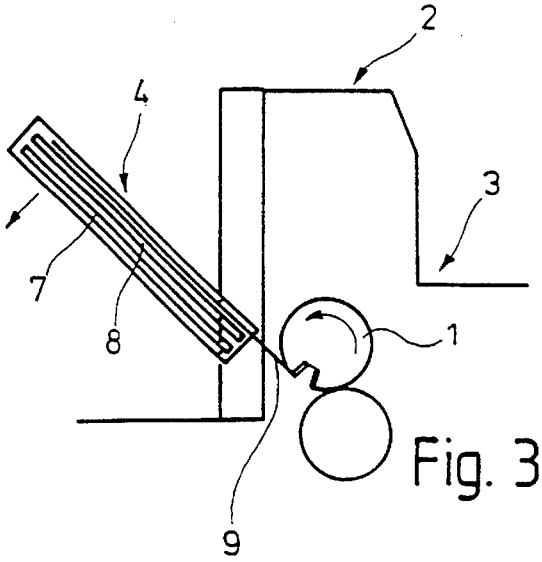
FIG. 3 shows the magazine in the plate-changing position while a new printing plate to be used is supplied to the plate cylinder of the printing press.
Figure 4:
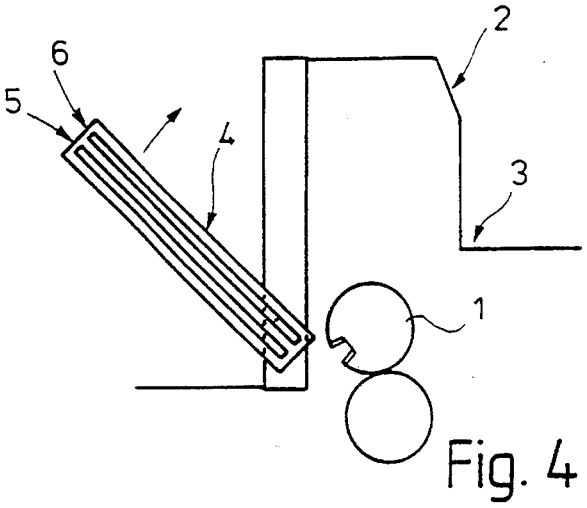
FIG. 4 shows a representation according to FIG. 3, with, however, the printing plate already having been clamped onto the plate cylinder.
Figure 5:
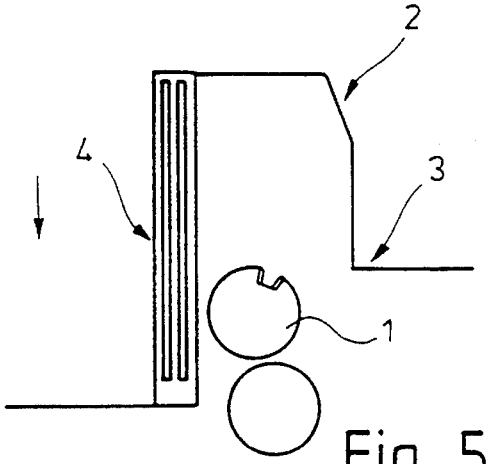
FIG. 5 shows the return of the magazine into the starting position.

Described hereinbelow are the individual positions of the magazine 4 which are assumed for the removal and/or supply of printing plates. If the plate cylinder 1 is to be supplied with a new printing plate 9, the magazine 4 moves—as shown in FIG. 2—vertically upwards into a center position and then—as shown in FIG. 3—swivels into an oblique position (approximately 45°, for example). By means of a plate-supplying apparatus (still to be described in greater detail) of the magazine 4, the printing plate 9 to be used is then supplied to the plate cylinder 1 and is clamped thereon (FIG. 4). Subsequently, the magazine 1 then swivels back into its vertical position and is then lowered again into the lower position (starting position) as shown in FIG. 5.

Figure 6:
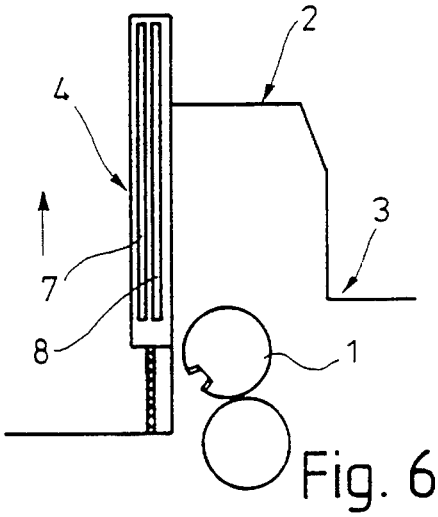
FIG. 6 shows the movement to the center position in order to accept a used printing plate.

The printing process can now be carried out. When the printing job has been performed, the printing plate 9 must be removed from the plate cylinder 1. For this purpose, a lifting device, in turn, lifts the magazine 4 into the center position (FIG. 6). Subsequently, as shown in FIG. 7, the magazine 4 is swiveled into the oblique position and—through releasing of the plate rear edge and backward rotation of the plate cylinder 1—the used printing plate 10 is partially inserted into the magazine 4 (FIG. 7).

As shown in FIG. 8, the used printing plate 10 is then pulled completely into the cassette 7 by a plate-removing apparatus (still to be described in greater detail) of the magazine 4. Next, the magazine 4 is again swiveled into its vertical position and then—as shown in FIG. 9—is lowered into the starting position.

Of course, it is also possible to combine the removal and supply of printing plates in order to effect the changing of printing plates. This means that, in the oblique position, a used printing plate 10 is first accepted by the magazine 4 and a new printing plate is then supplied to the plate cylinder 1. Once this has been done, the magazine 4 swivels back into the vertical and is lowered into the starting position.

Hereinbelow, the design of the magazine 4 is to be described in greater detail with reference to FIG. 10 to 12.

Figure 10:
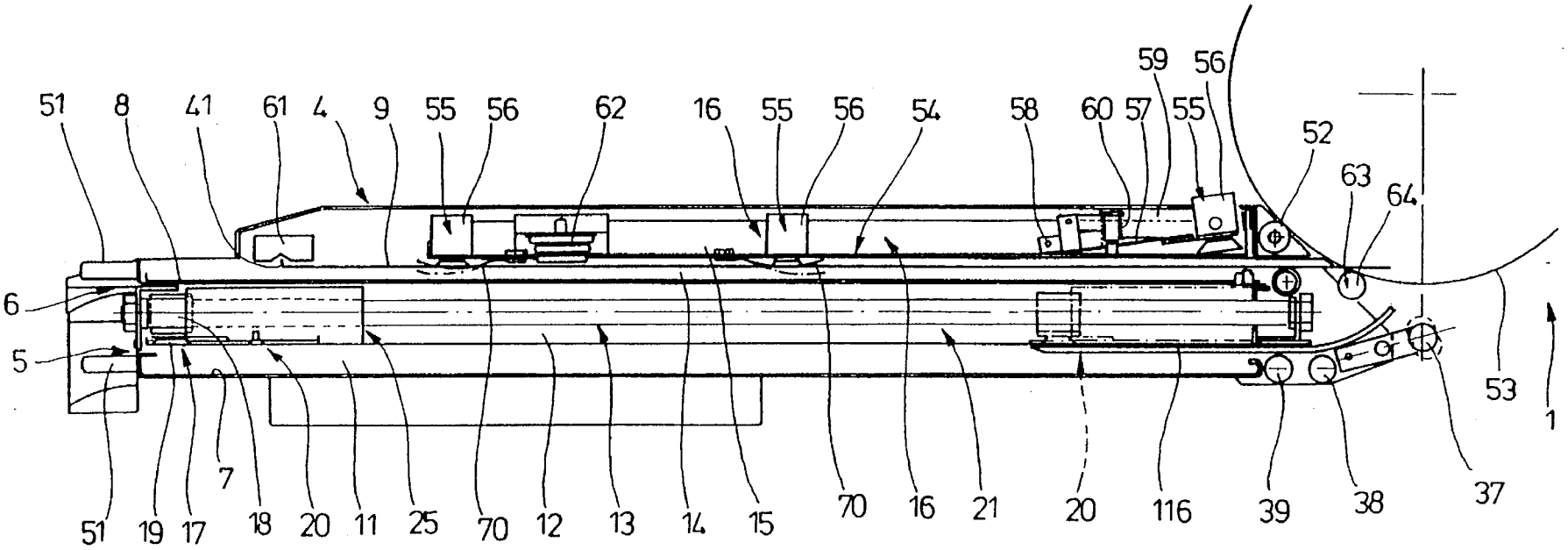
FIG. 10 shows a longitudinal section through the magazine.
Figure 11:
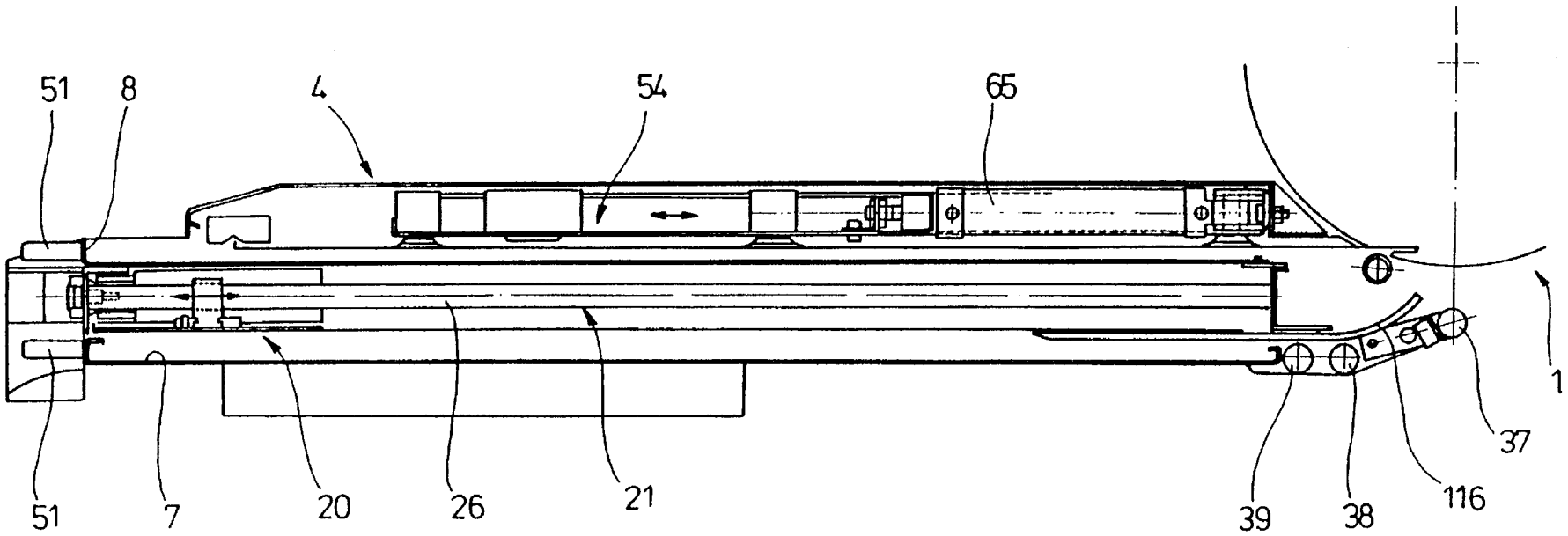
FIG. 11 shows a longitudinal section through the magazine according to FIG. 10, but in a different plane.
Figure 12:
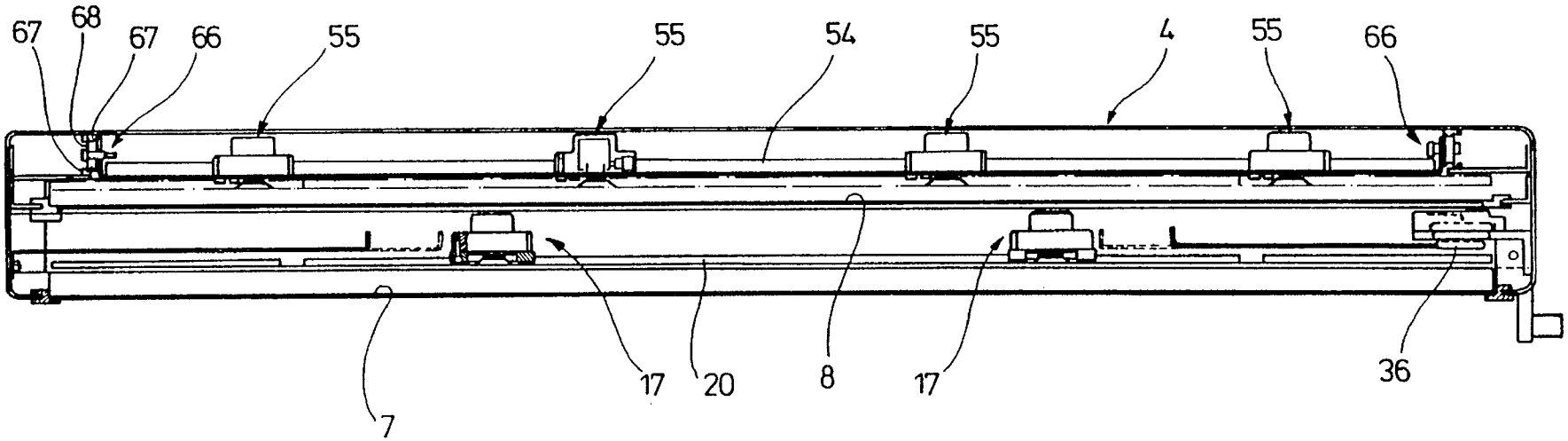
FIG. 12 shows a cross section through the magazine.

For graphical reasons, the magazine 4 is shown in FIG. 10 and 11 in a horizontal position in relation to the side edges of the drawing sheet. It should, however, be pointed out that the positions shown in FIG. 10 and 11 correspond to the oblique positions shown in FIG. 3, 4, 7 and 8.

The magazine 4 is of layered construction. It comprises an outer layer 11, which holds the cassette 7. Accommodated in a following layer 12 is a plate-removing apparatus 13, which is associated with the aforementioned cassette 7. The cassette 8 is disposed in a following layer 14. A further following layer 15 holds a plate-supplying apparatus 16, which cooperates with the printing plates 9 of the cassette 8.

Figure 17:
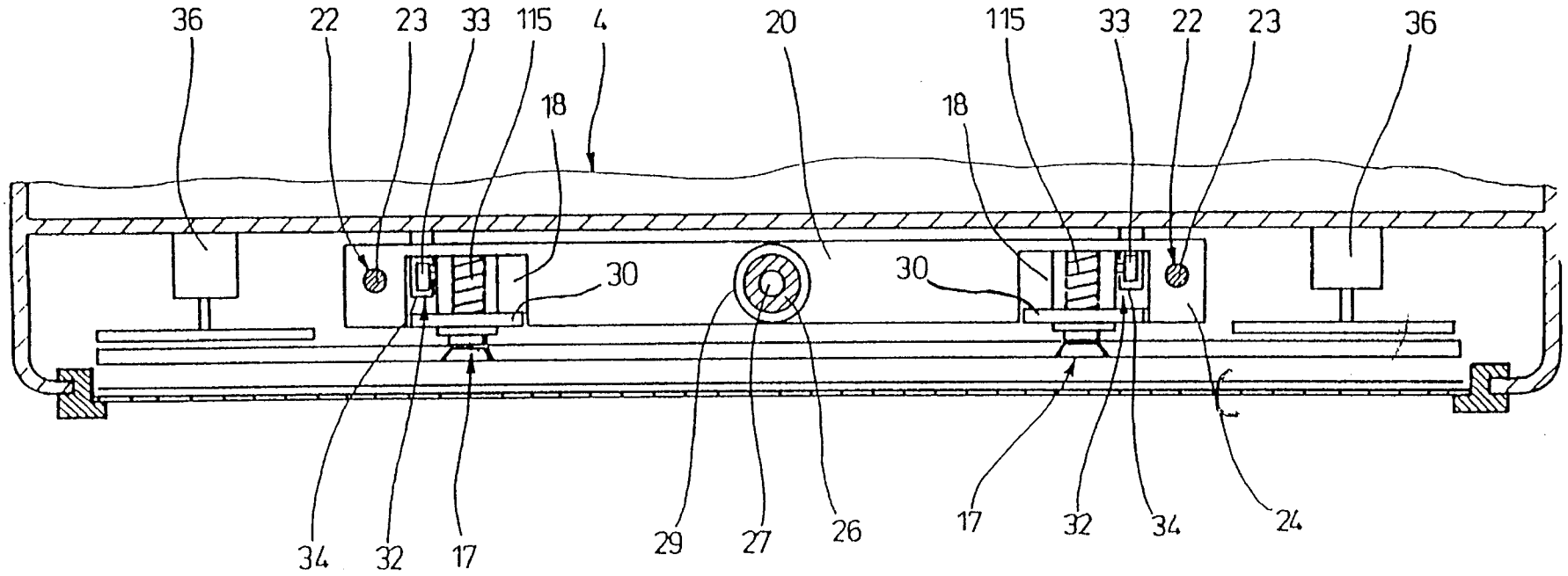
FIG. 17 shows a cross section through the magazine in the region of a plate-removing apparatus.

The plate-removing apparatus 13 comprises first holding means 17, which are in the form of activatable first suction elements 18. The suction pads 19 of the first suction elements 18 can be extended towards the printing plates 10 (for the sake of clarity, only one printing plate 9/10 is shown in each of FIG. 10 and 11). The first suction elements 18 are disposed on a first carriage 20, which is adapted to be moved along a first guide 21. As shown in FIG. 17, the guide 21 comprises two spaced-apart, parallel-extending guide parts 22, which are in the form of guide rods 23. The guide rods 23 are encompassed with little play by guide parts 24 of the first carriage 20.

The first carriage 20 is adapted to be moved along the first guide 21 by means of a driving apparatus 25. The driving apparatus 25 comprises a fixed, non-ferromagnetic tube 26 (an aluminium tube, for example), which extends from the top side to the bottom side of the magazine 4. Situated inside the tube 26 is a magnetic piston 27, which is adapted to be moved backwards and forwards inside the tube 26 by means of a pressure medium in addition to being positionable in desired positions. Situated on the first carriage 20 is a ferromagnetic component 28 which is in the form of a steel ring 29. Consequently, a movement of the magnetic piston 27 has the effect that the steel ring 29 and therefore the carriage 20 are moved through the intermediary of the magnetic field. Such a design provides a flexible coupling and, moreover, the carriage is movable from a position at the extreme top in the magazine 4 (shown by solid lines in FIG. 10) into a position at the extreme bottom (shown by broken lines in FIG. 10).

Figure 13:
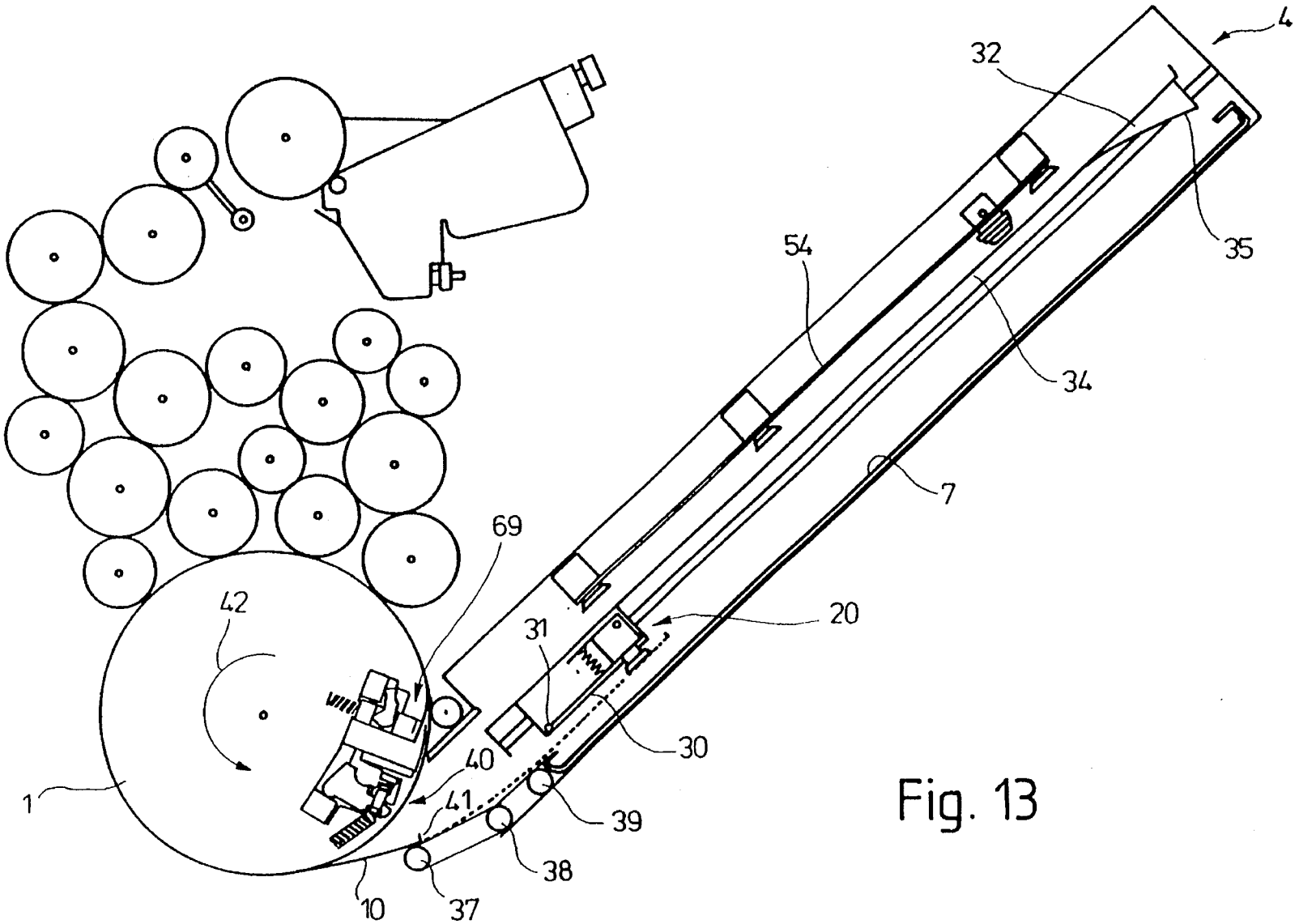
FIG. 13 shows a schematic view in the longitudinal section during the supply of a used printing plate to the magazine.

As shown in FIG. 17, a suction element 18 is disposed on either side of the driving apparatus 25. Each suction element 18 is attached to a lever 30, which is adapted to be swiveled towards the printing plate 10 by means of a hinge 31 (FIG. 13). The position of the levers 30 is determined by a forced-control device 32 (see also FIG. 13), which is formed by a roller 33 connected to each lever 30, said roller 33 running in a location-fixed guide rail 34. Each guide rail 34 comprises in the upper region of the magazine 4 a bevelled section 35 (FIG. 13), with the result that, with the carriage 20 moving into an upper position, the rollers 33 contact the bevelled sections 35 and thereby swivel the levers 30 and thus the suction elements 18 towards the printing plate 10. Springs 115 serve to return the lever 30 and to make the rollers 33 contact the bevelled sections 35.

Disposed on opposite sides in the lower region of the magazine 4 are actuatable holders-down 36, which serve to engage the printing plate 10 in said region. Furthermore, guide rollers 37, 38 and 39 are disposed in the lower region of the magazine 4.

Figure 14:
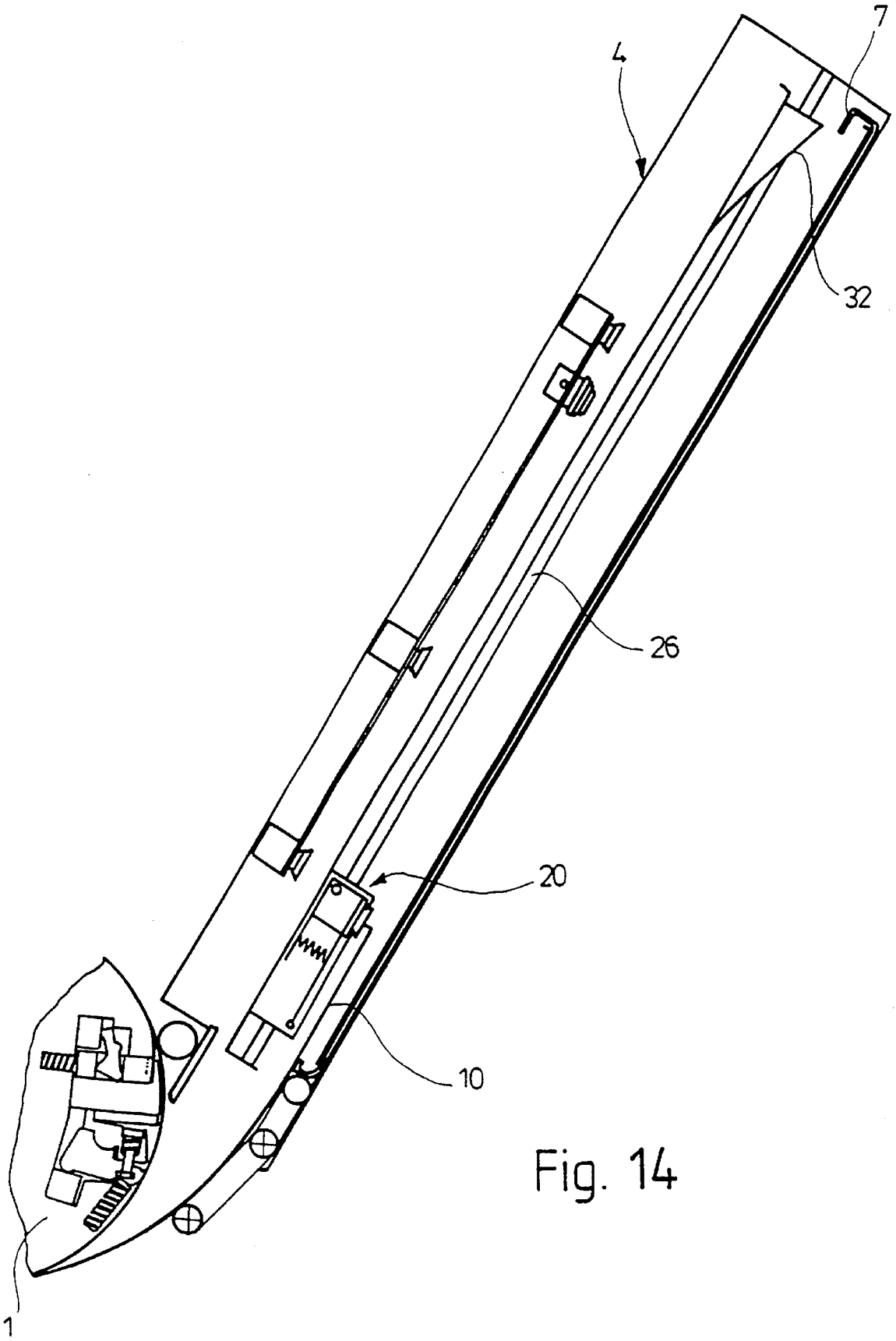
FIG. 14 shows a representation according to FIG. 13, but with the printing plate introduced further.
Figure 15:
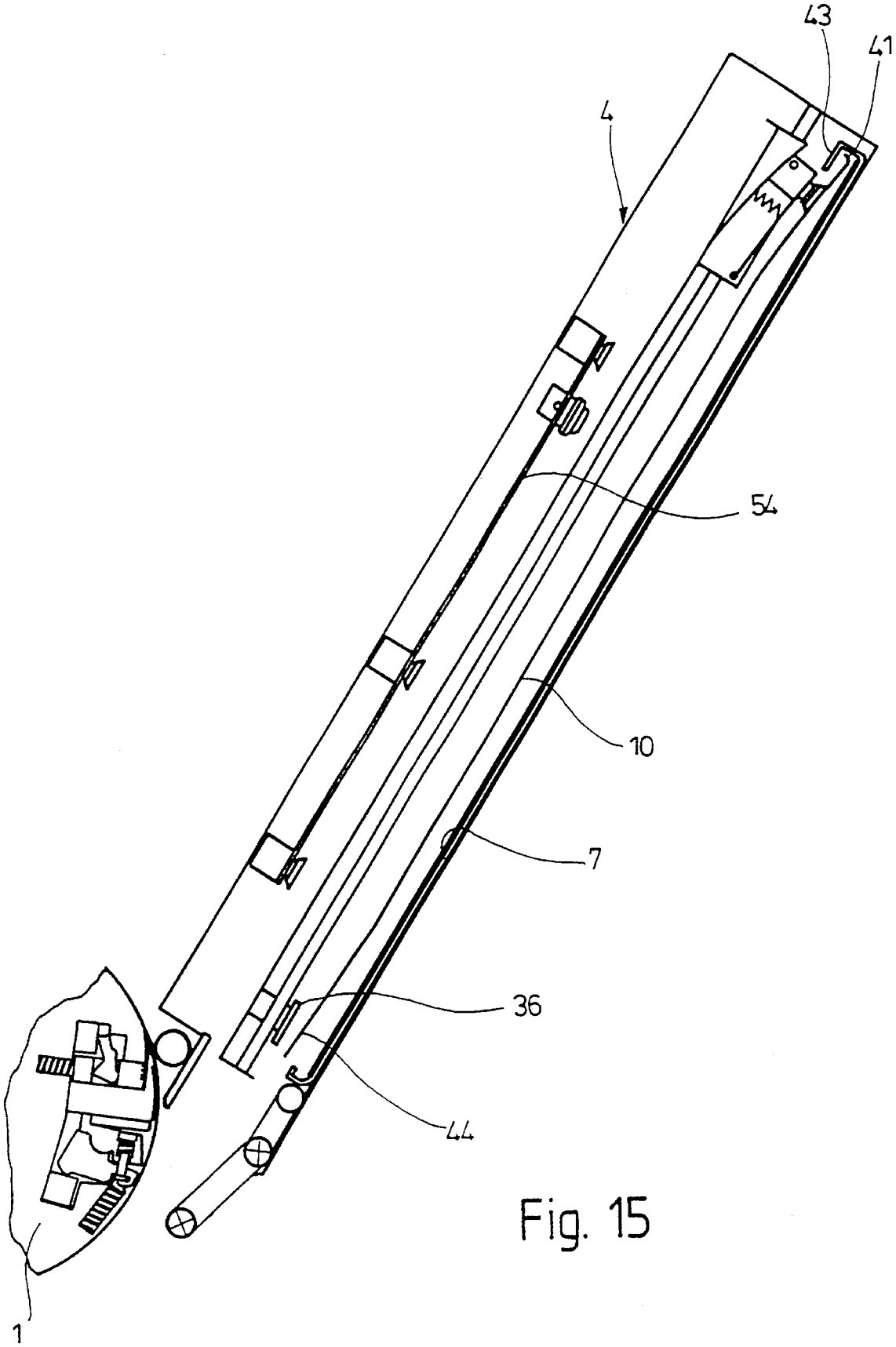
FIG. 15 shows the magazine in the longitudinal section with the printing plate completely introduced.
Figure 16:
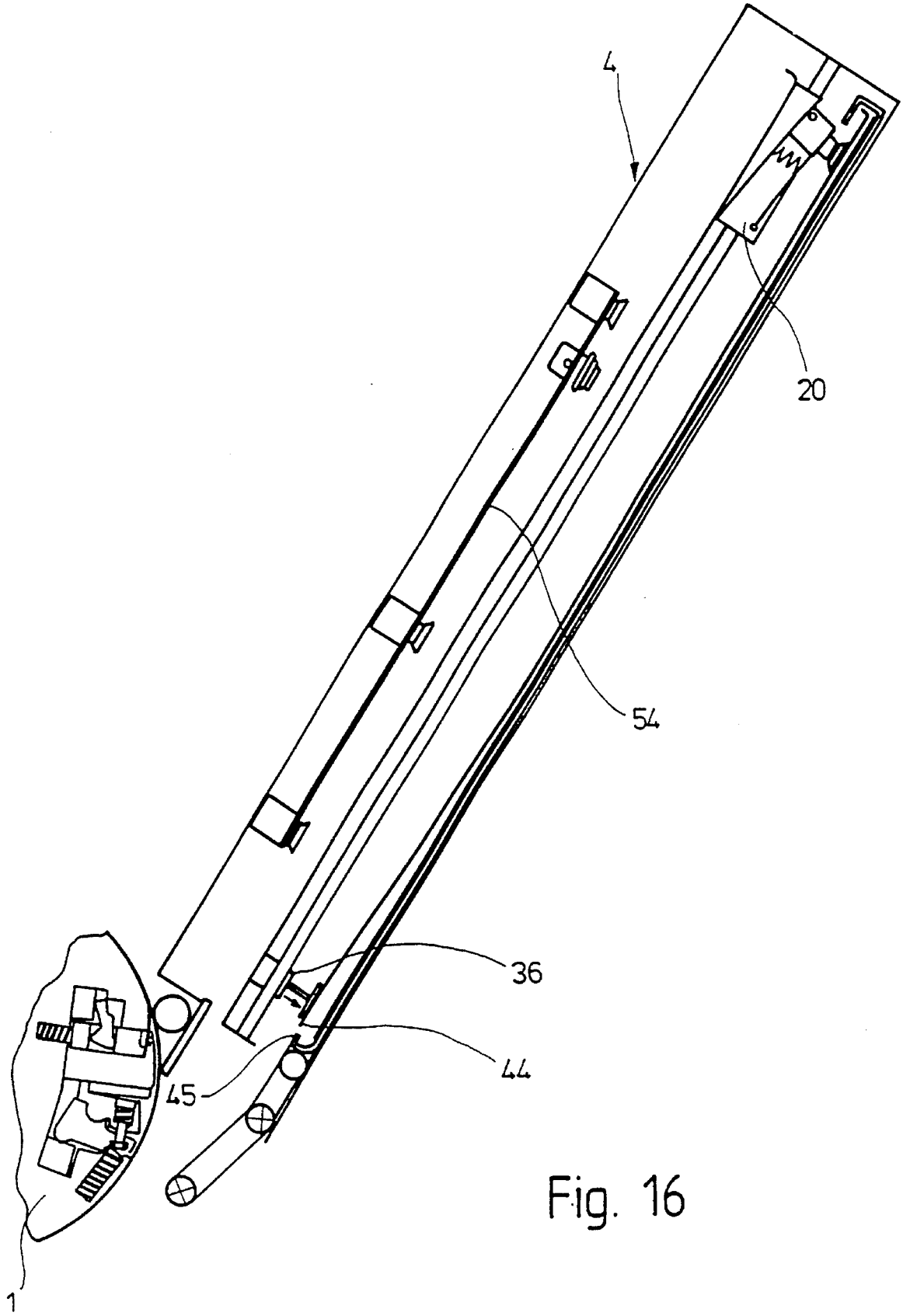
FIG. 16 shows a representation according to FIG. 15, but with the front edge of the printing plate being introduced into a cassette of the magazine.

Hereinbelow, there is a functional description of the removal of a used printing plate 10 from the plate cylinder 1 into the cassette 7 of the magazine 4. For this purpose, first of all, the magazine 4 is—as shown in FIG. 6 and 7—brought into the required oblique position. Subsequently, a rear-edge clamping device 40 of the plate cylinder 1 opens and releases the there-clamped, angled printing-plate rear edge 41. Owing to the inherent elasticity, the rear end of the printing plate 10 consequently strikes against the guide roller 37 (FIG. 13). Subsequently, through backward rotation (arrow 42) of the plate cylinder 1, the printing plate 10 is inserted into the cassette 7 of the magazine 4. The guide rollers 37, 38 and 39 assist with the introduction of the rear-edge end of the printing plate 10. Guide rails 116 may be provided, said guide rails 116 sliding in cutouts of the printing-plate rear edge 41. Said introduction is shown by a dotted line in FIG. 13 and by an unbroken line in FIG. 14. When approximately one-third of the printing plate 10 has been inserted into the magazine 4, the suction elements 18 of the carriage 20 (the carriage 20 being in the lowermost position inside the magazine 4) are activated; that is, the suction pads 19 move towards the printing plate 10 to be held and firmly adhere by suction to the printing plate 10. Next, with simultaneous further backward rotation of the plate cylinder 1, the carriage 20 moves into its upper position, as a result of which the printing plate 10 is pulled completely into the magazine 4, with the front edge 44 of the printing plate 10 also being unclamped. When the carriage 20 enters the upper end region of the magazine 4, the rollers 33 contact the bevelled sections 35 and swivel the levers 30, with the result that—as shown in FIG. 15—the angled printing-plate rear edge 41 comes under a holding edge 43 of the cassette 7. Subsequently, the holders-down 36 press down the printing plate 10 in the region of its front edge 44 (FIG. 16), with the result that the front edge 44 comes to lie at a lower position than a holding edge 45 of the cassette 7. Through the force of gravity and/or through movement of the carriage 20, the front edge 44 is then brought under the holding edge 45 through pulling-down of the printing plate 10. Consequently, the printing plate 10 is safely disposed in the cassette 7. Particularly if a plurality of already used printing plates 10 are to be accommodated in the cassette 7, it is necessary for the last-inserted printing plates 10 to be pulled down by means of the carriage 20 and to be held by the holders-down 36, so that they come under the holding edge 45, since, owing to relatively great stresses at the start of the printing plate, the force of gravity alone is no longer sufficient to move the printing plates 10 into said position.

The removal of the used printing plates 10 from the magazine 4 is accomplished in simple manner in that the cassette 7 is withdrawn from the associated holding shaft 5.

Figure 18:
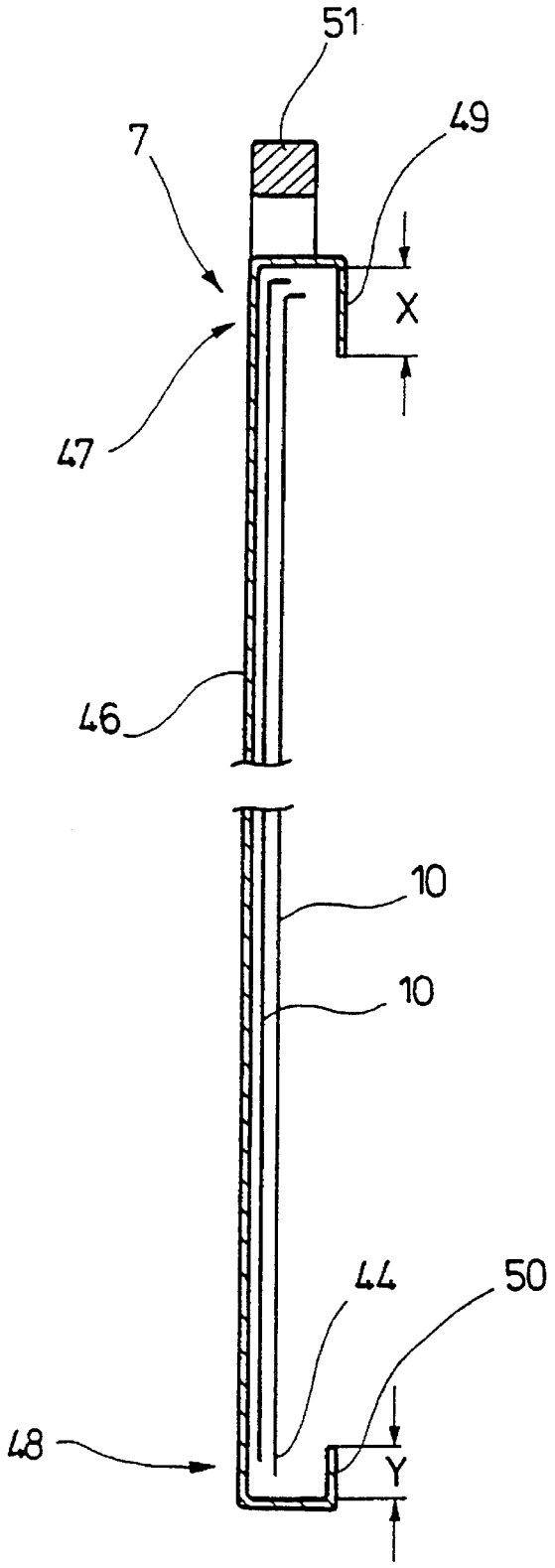
FIG. 18 shows a longitudinal section through the cassette.

FIG. 18 shows a longitudinal section through a cassette 7. The cassette 7 comprises a base 46, which is adjoined by U-shaped upper and lower edge regions 47, 48. The upper edge region 47 comprises a U-shaped leg 49 and the lower edge region 48 comprises a U-shaped leg 50, which forms the holding edge 45. The length x of the U-shaped leg 49 is greater than the length y of the U-shaped leg 50. The clear distance between the ends of the U-shaped legs 49 and 50 is selected such that a printing plate 10 to be inserted is first slid under the U-shaped leg 49 and is then swung into the interior of the cassette 7, with the front edge 44 passing the U-shaped leg 50. Subsequently, the printing plate 10 is then displaced in such a manner that its front edge 44 passes under the U-shaped leg 50, without, however, the locating action of the U-shaped leg 49 being lost—thanks to the greater length of the U-shaped leg 49.

Consequently, the printing plate 10 is safely accommodated inside the cassette 7. The procedure is similar when removing a printing plate 9 from a cassette 8, insofar as use is made also of a cassette with locating edges. It is, however, also possible to use a design without locating edges as the cassette 8.

Each cassette 7 or 8 comprises in its upper region a handle 51 in order to facilitate insertion and removal from the respective holding shaft 5 or 6 of the magazine 4. In addition, the handle 51 also makes it easier for the corresponding cassette 7 or 8 to be transported to the printing press. Furthermore, each cassette 7 or 8 is provided with a marking, particularly a colour marking (this may be disposed, for example, on the handle 51), said marking relating to the respective printing unit 2 of the printing press 3. For example, the handle 51 may be of a colour corresponding to the printing ink of the respective printing unit 2. Unambiguous identification is made possible in this manner.

Reference may be made already at this point to a special feature of the cassette 8 containing the new printing plates 9 yet to be used, although the removal of the printing plates 9 from the cassette 8 will be discussed at a later point hereinbelow. If there is a plurality of printing plates 9 piled one on top of the other inside the cassette 8, then it is possible, when the uppermost printing plate 9 is removed, for a vacuum to be formed with respect to the following printing plate 9. This may result in two printing plates being removed simultaneously by mistake owing to the fact that they "stick together". To prevent this, a special removal technique is implemented and will be discussed in greater detail hereinbelow; moreover, it is possible to provide spacers between the individual printing plates 9, with the result that the formation of a vacuum is prevented. The spacers are preferably in the form of plastic tabs. These can be clipped preferably into locking seats in the edge regions. An advantageous further development of the invention provides that the spacers are in the form of two rows of individual tabs, with, when the printing plates are being inserted, a tab being placed between every two printing plates on both sides. It is advantageous for said tabs to be disposed in the region of the front row of suckers, which goes into action first. Consequently, when a cassette 8 is being furnished with printing plates, spacers are first of all clipped in position before a further printing plate 9 is laid on a printing plate 9 already in the cassette 8. The spacers are so flexible that they yield when the printing plate below is removed.

If, after the removal of a printing plate 10, a new, as yet unused printing plate 9 is to be clamped immediately onto the plate cylinder 1, then the magazine 4 remains in its oblique position and a new printing plate 9 is taken from the cassette 8. This is accomplished by means of the plate-supplying apparatus 16.

In order for a printing plate 9 from the cassette 8 to be supplied to the plate cylinder 1 by means of the plate-supplying apparatus 16, the magazine 4 is—as mentioned hereinbefore—in its oblique position in which support rollers 52 are supported on cylinder bearers 53 associated with the plate cylinder 1. The plate-supplying apparatus 16 comprises on a second carriage 54 second holding means 55, which are likewise in the form of activatable suction elements 56 (second suction elements). As shown in FIG. 10 and 12, the suction elements are each disposed spaced-apart in rows in groups of four, with three rows being provided on the second carriage 54. It is also possible for the lower row of suction elements 56 nearest to the plate cylinder 1 to be equipped with four suction elements 56 and for the other rows each to be provided with three. The suction elements 56 disposed in the lower row associated with the plate cylinder 1 are attached to levers 57, which are adapted to be swiveled about shafts 58. Pneumatic cylinders 59 are provided for the actuation of the levers 57. Furthermore, the levers 57 are subjected to the force of a spring 60. Disposed in the upper region of the magazine 4 is a preferably optical sensor 61, which monitors the position of the associated printing plate 9, particularly the position of the rear edge 41 thereof. Disposed between the upper and middle rows of suction elements is an activatable pressing-down device 62 for engagement of the printing plates 9. In addition, the magazine 4 comprises at its lower end a displaceable pressing-on element 63, which is in the form of a pressing-on roller 64 displaceable radially with respect to the plate cylinder 1.

The second carriage 54 is movable along a second guide 66 (FIG. 12) by means of a piston/cylinder unit 65. The second guide is formed by fixed profile rails 67, in which run guide rollers 68 of the carriage 54.

For the supplying of a printing plate 9, the lowermost suction elements 56, associated with the plate cylinder 1, may first of all come into operation, with the levers 57 being in their non-deflected positions. Thereafter, the suction elements 56 of the middle row of suckers and then the suction elements 56 of the upper row of suckers are activated. A different sequence, such as first the middle row and then the row at the edge, is conceivable. The non-simultaneous, but consecutive activation of the rows of suction elements ensures that the uppermost, new printing plate 9 is lifted in such a manner that no vacuum or only a very small vacuum is formed with respect to the further printing plate 9 below. This guarantees that only one printing plate 9 is lifted. As for the rest, the aforementioned spacers (plastic tabs) may be disposed between the individual printing plates 9, which additionally counteracts the formation of a vacuum. When the printing plate 9 has been lifted, the carriage 54 is pushed towards the plate cylinder 1 by means of the piston/cylinder unit 65. The front edge 44 of the printing plate 9 enters the front-edge clamping device 69 of the plate cylinder 1, which was appropriately positioned beforehand. During the above-depicted advance of the carriage 54, the angled printing-plate rear edge 41 slides through under the sensor 61, which registers the correct transport of the printing plate 9. During the transport of the carriage 54, a bypass in the air supply to the suckers of the suction elements 56 is activated, since a strong suction air is required only for the suction-gripping of the printing plate 9. After the carriage 54 has almost reached its outermost position facing the plate cylinder 1, the suckers of the lowermost and middle rows of suction elements 56 are rendered pressureless or are provided only with a weak vacuum; the printing plate 9 is therefore held only by the uppermost row of suckers. The purpose of this is so that the printing plate 9 can be better aligned. Subsequently, the front-edge clamping device 69 is closed, with the result that the front edge 44 of the printing plate 9 is firmly clamped. Next, the plate cylinder 1 rotates in the forward direction, pulling the printing plate 9 onto its outer cylindrical surface. Thanks to the bypass, the suction elements are provided only with a weak vacuum, with the result that they still hold the printing plate, but the printing plate can still be displaced on the suction elements through the rotation of the plate cylinder. Before the printing-plate rear edge passes the two upper rows of suckers, the latter are rendered pressureless and brackets 70 ensure that the angled rear edge slides past the suction elements without collision. Owing to its proximity to the plate cylinder 1, the printing plate 9 is relatively rigid in the region of the lower row of suction elements 56, with the result that, for the passage of the angled printing-plate rear edge 41, a lever 57, in the form of a plate with hinge and carrying the entire row of suckers, or a plurality of levers 57 are swivelled into their positions shown in FIG. 10 by means of one or more cylinders 59, with the result that the printing-plate rear edge 41 is able properly to pass the row of suckers. Subsequently, the pressing-on roller 64 is moved radially towards the plate cylinder 1, as a result of which the angled printing-plate rear edge 41 is pressed into the rear-edge clamping device 40 of the plate cylinder 1. The rear-edge clamping device 40 closes and then tensions the printing plate through appropriate displacement in the circumferential direction of the plate cylinder 1. Thereafter, the carriage 54 is moved back to its original position in order, at the appropriate time, to grip the next printing plate 9.

The device moves back into its starting position in that the cylinders 59 are rendered pressureless, with the result that the springs 60 are able to ensure that the lever(s) 57 return to their original positions.

Subsequently, the pressing-down device 62 comes into action, ensuring that the remaining printing plates 9 remain properly in the cassette 8 and are unable to tip out, particularly when the magazine 4 is swiveled back into its vertical position.

FIG. 10 shows that the upper and middle rows of suction elements 56 are associated with elastic brackets 70. The elasticity of the brackets 70 permits the suction-gripping of the printing plate 9 that is to be used; that is, the brackets 70 do not disrupt this operation. As soon as the suction elements 56 no longer have any vacuum and, to that extent, the printing-plate rear edge 41 slides past the suction elements 56 during the supplying of the printing plate 9, the brackets 70 ensure that the angled printing-plate rear edge 41 does not catch on the suckers of the suction elements 56.

What is claimed is:

1. In a printing machine, an apparatus for removing and delivering printing plates to a printing plate cylinder of the printing machine for automatic printing plate exchange, comprising:

a magazine, a plate removal and a plate delivery device disposed in said magazine, said plate removal device having first retaining means;

said plate delivery device having a plurality of second retaining means for the printing plate disposed in distributed fashion and activatable successively;

a sensor disposed in said magazine for monitoring a rear edge of the printing plate with regard to satisfactory delivery to the printing plate cylinder;

said second retaining means including a retaining device associated with a front edge of the printing plate, said retaining device being shiftably mounted for shifting in controlled fashion transversely to a plane defined by the printing plate upon delivery of the printing plate to the printing plate cylinder so that the rear edge of the printing plate can move past said retaining device without colliding therewith.

2. The apparatus according to claim 1, wherein said second retaining means are disposed in distributed fashion over a length of the printing plates to be used.

3. The apparatus according to claim 2, wherein said second retaining means are disposed in rows.

4. The apparatus according to claim 1, wherein said second retaining means are embodied as activatable suction devices.

5. The apparatus according to claim l, including a carriage and a guide disposed in said magazine, said second retaining means being disposed on said carriage, and said carriage being movable along said guide.

6. The apparatus according to claim 1, wherein said retaining device of said second retaining means release the printing plate, located approximately in a clamping position, before the front edge of the printing plate is firmly clamped to the printing plate cylinder.

7. The apparatus according to claim 6, wherein said second clamping means include further clamping devices associated with the rear edge of the printing plate, said further clamping devices, during a clamping process in which the front edge of the printing plate is clamped at the plate cylinder, continuing to hold respective printing plate.

8. The apparatus according to claim 1, wherein the printing plates have angled rear edges, and including a pressure-exerting roller being shiftable radially towards the printing plate cylinder (1), for introducing the angled rear edge of a respective printing plate into a clamping device of the printing plate cylinder.

9. The apparatus according to claim 1, wherein said magazine defines a space for receiving plate cassettes, and including a cassette holding a plurality of printing plates to be delivered to the printing plate cylinder, said cassette being insertable into said space in said magazine.

10. The apparatus according to claim 9, including a hold-down device acting upon the printing plates transversely to the plane defined thereby, to prevent the plates from tipping out of the respective cassette.

11. The apparatus according to claim 9, including spacers disposed in said cassette, said spacers being disposed between mutually adjacent printing plates.

12. The apparatus according to claim 11, wherein said spacers are embodied as plastic tongues.

13. The apparatus according to claim 11, wherein said spacers are secured in said cassette in detent fashion.

14. The apparatus according to claim 11, wherein said spacers are embodied as two rows of individual tongues, said tongues being disposed along peripheral regions of said cassette in such a manner that on both sides, one tongue each can be placed between two respective printing plates.

15. The apparatus according to claim 14, wherein said spacers are disposed on both sides in a region of a front row of suction devices.

16. The apparatus according to claim 9, wherein said cassette includes a color identification relating to an associated printing unit and thus to a color of ink to be printed with the printing unit.

17. The apparatus according to claim 16, wherein said color identification has the same color as the printing ink in the respective printing unit.

* * * * *